US011384906B2

(12) United States Patent
Depiere et al.

(10) Patent No.: US 11,384,906 B2
(45) Date of Patent: Jul. 12, 2022

(54) METHOD FOR MONITORING A WATER SUPPLY NETWORK IN AN INFRASTRUCTURE OBJECT, A CONTROL COMPONENT FOR A WATER SUPPLY NETWORK AND A COMPUTER PROGRAM PRODUCT

(71) Applicant: GROHE AG, Hemer (DE)

(72) Inventors: Bert Depiere, Wakkerzeel (BE); Robert Veltrup, Duesseldorf (DE); Philip Speck, Iserlohn (DE)

(73) Assignee: GROHE AG, Hemer (DE)

( * ) Notice: Subject to any disclaimer, the term of this patent is extended or adjusted under 35 U.S.C. 154(b) by 0 days.

(21) Appl. No.: 17/212,452

(22) Filed: Mar. 25, 2021

(65) Prior Publication Data

US 2021/0301984 A1 Sep. 30, 2021

(30) Foreign Application Priority Data

Mar. 27, 2020 (DE) ..... 102020108553.2

(51) Int. Cl.
*F17D 5/02* (2006.01)

(52) U.S. Cl.
CPC ..... *F17D 5/02* (2013.01)

(58) Field of Classification Search
CPC ..... F17D 5/02; G01M 3/2807; G01M 3/2815; G05B 19/0425; G06F 16/245; G06Q 50/06; H04W 52/0216; G16H 40/63; H04N 1/00816
See application file for complete search history.

(56) References Cited

U.S. PATENT DOCUMENTS

| | | | | |
|---|---|---|---|---|
| 2013/0170417 | A1* | 7/2013 | Thomas | H04W 52/0216 370/311 |
| 2013/0211797 | A1* | 8/2013 | Scolnicov | G06Q 50/06 703/2 |
| 2017/0030798 | A1* | 2/2017 | DeVerse | G16H 40/63 |
| 2017/0131174 | A1* | 5/2017 | Enev | G01M 3/2815 |
| 2017/0350103 | A1* | 12/2017 | Lee | G05B 19/0425 |
| 2020/0314282 | A1* | 10/2020 | Namba | H04N 1/00816 |
| 2020/0401971 | A1* | 12/2020 | Tominaga | G06F 16/245 |
| 2021/0131905 | A1* | 5/2021 | Yu | F17D 5/02 |
| 2021/0172824 | A1* | 6/2021 | Parson | G01M 3/2807 |

FOREIGN PATENT DOCUMENTS

| | | | |
|---|---|---|---|
| DE | 10 2017 005 499 | | 12/2018 |
| GB | 2576501 | | 2/2020 |
| JP | 2006349485 | * | 6/2005 |
| KR | 20110086527 | * | 7/2007 |

* cited by examiner

*Primary Examiner* — Catherine T. Rastovski
*Assistant Examiner* — Kaleria Knox
(74) *Attorney, Agent, or Firm* — Wenderoth, Lind & Ponack, L.L.P.

(57) ABSTRACT

Method for monitoring a water supply network (1) in an infrastructure object (2) having water pipes (3) and at least one measuring device (4) for monitoring the water supply network (1) that contains at least the following steps: a) determining at least one structure parameter (5) which characterizes at least one structure of the infrastructure object (2) or the water supply network (1); b) determining at least one water parameter (6) using the at least one measuring device (4), and c) determining at least one probability value (7) for water damage, wherein at least one structure parameter (5) and the at least one water parameter (6) are taken into consideration.

14 Claims, 1 Drawing Sheet

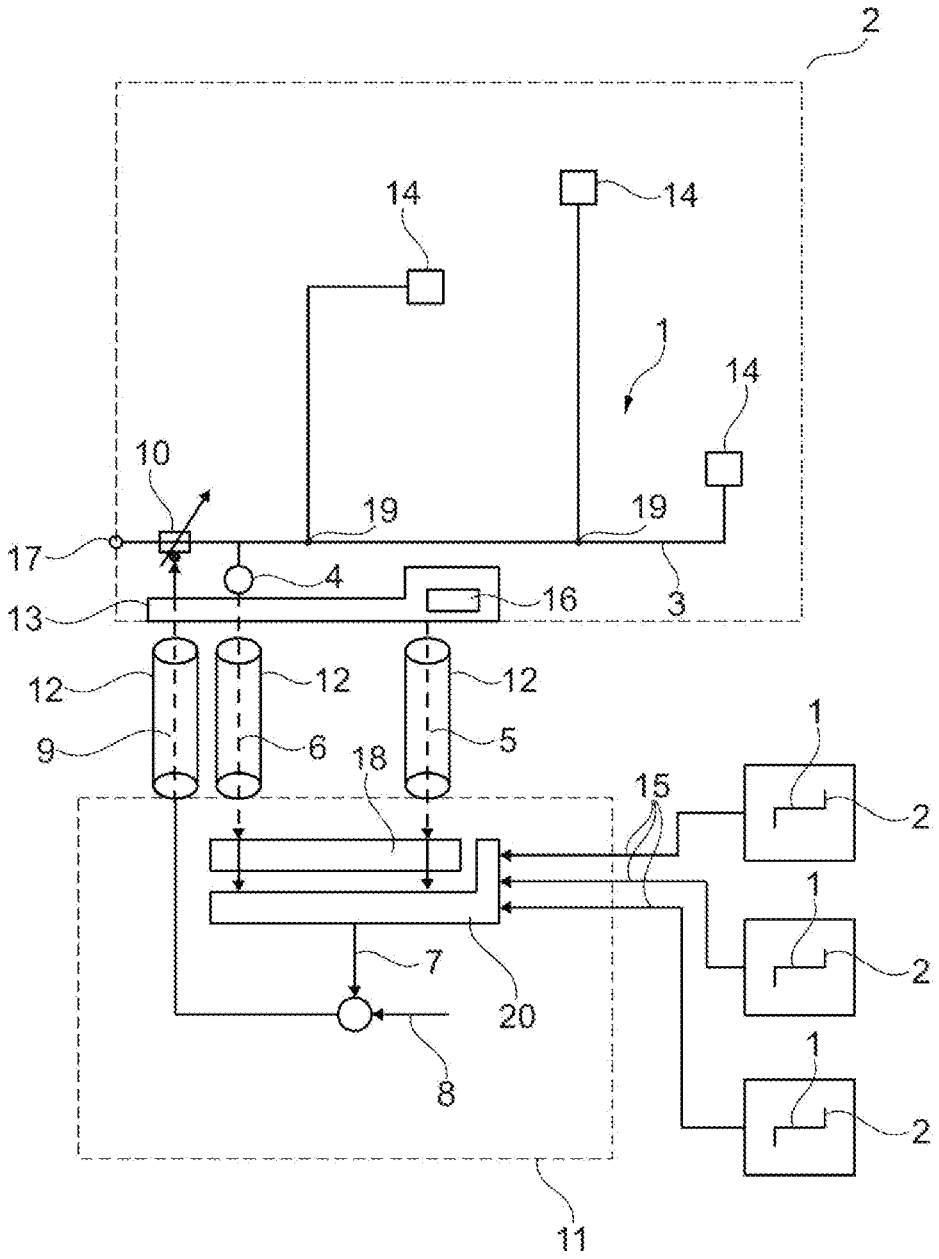
2
14
14
1
14
10
19
19
17
4
16
3
13
12
12
12
9
6
5
18
15
1
2
1
2
7
20
8
1
2
11

METHOD FOR MONITORING A WATER SUPPLY NETWORK IN AN INFRASTRUCTURE OBJECT, A CONTROL COMPONENT FOR A WATER SUPPLY NETWORK AND A COMPUTER PROGRAM PRODUCT

This application claims priority to German Patent Application No. 102020108553.2, filed Mar. 27, 2020, which is incorporated by reference herein in its entirety.

The present invention relates to a method for determining a probability value for water damage in an infrastructure object, for example in a structure, in particular an industrial or residential building. The method is suited in particular for reducing and even avoiding water damage and its consequences.

Water damage in an infrastructure object may be caused by the uncontrolled flow of water from, for example, a water pipe, a fitting (such as a water faucet, a toilet or a shower head) and/or a machine (e.g. a dishwasher or a washing machine which is connected to the water line). Water damage may be caused in particular from a leak through which water escapes from the water pipes of a water distribution system. In general, water pipes of a water supply network in an infrastructure object are connected to a water source (e.g. a building connection). Water can flow without limit by way of the water source. In the case that the water escapes in an uncontrolled manner from the water supply network and the flow of water by way of the water source is ensured, such water damage can be very extensive.

Water damage can also impair the integrity of a structure of the infrastructure object. This is true in particular if, for example, essential components of the structure consist of sensitive materials, for example, if it is a wooden structure, which can mold under the influence of water. In the case of water damage, it is known that the main valve which controls the flow of water from a main water line is closed, and the reason for the uncontrolled flow of water is eliminated before the main valve is reopened.

It is also known that a water detection apparatus is provided in or on the infrastructure object. A water detection apparatus may be arranged in a region in which water damage would foreseeably first or with greatest probability be noticed. Such a region may, for example, be near a water line, near a fitting and/or machine. Should the water detection apparatus detect increased dampness or wetness (via a sensor) in the (usually dry environment), an alarm could be activated and measures could be taken to contain the damage.

It is further known to detect a leak by means of special testing methods in a building. For this purpose, flow or pressure temperatures for the water in the line may be provided at the main valve of the building. Should the detected flow and/or pressure values deviate in specifiable test routines from the expected or specified values, an automatic closure of the main valve may be performed, whereby greater damage may possibly be avoided. These testing methods may possibly also serve to detect or limit the site of the leak.

However, the known solutions only prevent further water damage when considerable water damage has already occurred. Accordingly, a method and a system for more efficient avoidance of water damage are desirable.

Proceeding therefrom, it is the task of the present invention to, at least partially, solve the problems described with reference to the prior art, and in particular to disclose a method for determining a probability value for water damage by means of which water damage may at least partially be prevented.

These problems are solved with a method for monitoring a water supply network according to the features of claim 1. Advantageous further developments, including a control component and a computer program product, are specified in the dependent claims. It should be noted that the features listed in the claims can be combined with one another in any technologically meaningful manner and be provided with further embodiments of the invention. The description, in particular also in connection with the illustrations, explains the invention and lists further embodiments.

A method for monitoring a water supply network in a building in which a water supply network with water pipes and at least one measuring device for monitoring the water supply network are realized, contributes to this. The method comprises at least the following steps:

a) Determining (detecting) at least one structure parameter which characterizes a structure of the infrastructure object and/or the water supply network;

b) Determining (or detecting) at least one water parameter which characterizes the water in the water supply network;

c) Determining at least one probability value for water damage, wherein at least one structure parameter and the at least one water parameter are taken into consideration.

The water supply network is a pipe system which in principle may be configured in any way, and which usually serves to supply water to consumer components. Consumer components are all components with which water may be provided and/or consumed, such as water faucets, showers, bathtubs, dishwashers, refrigerators with a water connection, heating systems, etc. The water supply network usually comprises water pipes and branch pies and may comprise any other components which are provided for distributing and possibly preparing the water, for example, heating components, filters, disinfecting components, pipe branches, valves, measuring devices, etc.

The infrastructure object is any device (usually fixed at a specific geographical position), which is preferably used by people. Typical infrastructure objects are residential buildings. But this also includes public buildings, factories of all kinds, etc. They may also be mobile infrastructure objects, such a mobile homes or trailers. The water supply network is preferably fixedly installed in or at the infrastructure object (at least temporarily), in order to supply water within the infrastructure object for consumer components arranged or installed therein.

Structure parameters according to step a) are all conceivable parameters which describe the infrastructure object and/or the situation of the infrastructure object. It is possible to determine not only one structure parameter in step a); rather a set of structure parameters may be determined and/or a structure parameter with a plurality of individual values (scalars) may be determined as vector or matrix. The at least one structure parameter or set of structure parameters may describe the structure of the infrastructure object (as a whole or in parts). The structure parameter may (from experience) be generated, saved, and/or detected. It is possible that identification data, measured values, data, etc. is used for the determination of the structure parameter by way of sensors or automatically, wherein the structure parameter may be calculated or specified on the basis thereof.

Water parameters according to step b) are all conceivable parameters which describe the properties and/or the behavior of the water in the water supply network. It is possible to determine not only one water parameter in step a); rather a set of water parameters may be determined and/or a water parameter with a plurality of individual values (scalars) may be determined as vector or matrix. The at least one water parameter or set of water parameters may describe the properties and/or the behavior of water in the water supply network (in whole or in part). It is possible that identification data, measured values, data, etc. is used for the determination of the water parameter by way of sensors or automatically, wherein the water parameter may be calculated or specified on the basis thereof.

Water parameters are gained in particular using at least one measuring device (directly or indirectly). The measuring device already mentioned above may be any device with which the water parameters previously described can be provided. This includes, for example, pressure sensors, temperature sensors, chemical or physical sensors (in particular, chemical sensors) for determining material properties of the water, etc.

The term "monitoring" describes here in particular a (passive) control function with which the infrastructure object or the water supply network in the infrastructure object may be monitored.

The probability value according to step c) is preferably a value which indicates a probability that an event (in the present case water damage) occurs. The probability value may refer to the probability here in relation to a certain time interval in the future, for example 1 day, 5 days, a week, or a month. The probability value indicates, for example, the probability that the event occurs in this time interval. The probability value may (also additionally) have a severity or a significance of the event. Severity or significance mean here in particular the extent of possible water damage. In this case, it may be, for example, that the probability value is determined or established to be higher if an expected event or the expected water damage is more severe.

In the embodiment variants, a set of probability values may be determined and/or a probability value with multiple values is determined which comprises a plurality of individual values (scalars) as vector or as matrix. Such probability values may, for example, indicate different probabilities of occurrence and/or different (future) for different categories of water damage (in particular, different severities of water damage) and/or different probabilities of occurrence for different (future) time intervals.

The water damage referred to here is, in particular, leaks in the water supply network, consequential damages caused thereby and/or consequential damages caused by defective or incorrectly set consumer components.

With the method described here, it is possible using the probability value to react preventively to possibly occurring water damages and thus to anticipate or even possibly to completely avoid and/or at least reduce the consequences of water damage that occurs using the probability value. The method described here also makes it possible in particular to account for particularities of the infrastructure object in which the water supply system is arranged. For example, the effects of a leak and the possible water damage which may occur as a consequence of a leak are completely different, depending on which properties the infrastructure object has. For example, in a wooden building as an infrastructure object, much greater consequential damage may occur than in a building which is constructed with stone. Such particularities may be taken into consideration using the described method.

It is advantageous if after step c) the following method step is carried out:

d) Comparing the at least one probability value with at least one threshold value and introducing at least one protective measure as a function of a result of the comparison, wherein the protective measure serves at least to reduce or even to avoid the consequence of water damage or the risk of water damage.

The threshold value according to step d) is preferably also a probability value which indicates a limit probability from which point the protective measure should be introduced. It is also possible to determine a set of threshold value may be determined and/or a threshold value with a plurality of individual values (scalars) may be determined as vector or matrix. Preferably a threshold value has the same dimension (as vector or as matrix) or the same number of values as the probability value used. The at least one threshold value or a set of threshold values make is possible, depending on which threshold value (individual value) is gone under by which probability value, to introduce different protective measures, in order to be able to react appropriately to specific risks.

It is also advantageous, if as a function of the probability value, a control command is transmitted to a valve of the water supply network as a protective measure, wherein the valve is actuated by the control command in such a way that at least water damage and/or the risk of water damage is avoided or at least reduced.

A control command is in particular a command to a drive of the valve to actuate the valve. In preferred embodiments, the control command served to close a valve, so that no more water enters into the water supply network, in order to possibly completely prevent the occurrence of water damage. It is also possible that only a partial closure of a valve takes place, in order to at least reduce the consequences of water damage, because an escaping quantity of water is reduced.

It is particularly advantageous if at least method step c), and possibly also at least one further method step is performed on a server, wherein the server is arranged outside the infrastructure object and is connected to a control component of the water supply network by way of data connections. The control component is configured to transmit water parameters obtained with the measuring device to the server by way of the data connection, and to transmit control commands from the server to at least one valve of the water supply network.

A data connection exists between the water supply network and the server which can be used with various types of data transmission. This includes, for example, WLAN, LAN network connections, internet connection, wireless connections, telephone connections, etc.

The method steps a) and b) may possibly also be carried out on a server outside the infrastructure object. For this purpose, structure parameters and/or temporary water parameters in the infrastructure object may possibly be detected and transmitted to the server (with at least one measuring device), wherein the server then carries out the detection of the actual structure parameters and/or water parameters from these temporary parameters, in order to generate input values for carrying out step c).

The method may be used in particular in conjunction with machine learning methods, in order to guarantee a very high utilizability of the specific probability values to achieve the desired goals (to reduce or even prevent water damage and its consequences).

The performance of method steps on such a server makes it possible to use a complex algorithm to carry out the method steps, which algorithm would could not be carried out in the control component arranged within the infrastructure object in this manner. The algorithm for performing the method steps may for example comprise an extensive neural network or a machine-learning-capable module in which, based on experiential values obtained in a large number of water supply networks in infrastructure objects, a statement about a probability value for water damage is made.

It is particularly advantageous if the water parameter includes at least one of the following parameters:

Pressure in the water supply network;

Flow rate in the water supply network;

Temperature in the water supply network;

pH level;

Hardness;

Change in a pressure;

Change in a flow rate; or

Change in a temperature.

The water parameter may be a parameter which describes at least one property of the water which the water has based on its state in the water supply network. This includes, for example, the named parameters of pressure, flow rate, temperature, as well as the respective changes (over time) of the parameters. The water parameter is obtained in particular with the measuring instrument already described. The measuring instrument used is preferably suited for the determination of the respective water parameter.

The water parameter may also be inherent properties of the water. This includes, in particular, chemical and/or physical properties of the water as matter which may also be designated material properties. Examples for such material properties are, for example, the pH level or the hardness of the water, The risk of water damage occurring may depend on the indicated parameters. For example, it is possible that the risk is high if the pressure of the water is high, because then, for example, the probability of a leak occurring and/or of a component failing, is greater.

The indicated parameters pressure, flow rate, and temperature may each relate to a certain location or the water at a certain location in the water supply network. Such parameters may also be determined at different locations in the water supply network, each with measuring devices provided for it. The same is true of the changes in the parameters also listed.

It is also possible for the indicated material parameters pH level and hardness that they are measured centrally. It is also possible that these parameters are not measured, but rather are saved permanently for a respective water supply system in an infrastructure object (once). For example, the water hardness is usually dependent on the respective water company to which the water supply network in an infrastructure object is connected. The water hardness does not usually change, instead it is connected to fixed circumstances. To this extent, the water hardness can be set in a fixed manner.

The method is particularly advantageous if the determination of the at least one water parameter is performed with a historical model, wherein in the historical model, temporary water parameters are taken into consideration which were determined in the past in the water supply network.

With a historical model, effects may be considered which (temporary) water parameters had on the water supply network over a longer period of time. If, for example, unusually high pressure values and unusually high temperatures had an effect of the water supply network, this may lead to the water supply network being less resistant to high pressures and therefore that the probability values must be determined to be higher. The same is true, for example, if over a long span of time very high water hardnesses had an effect on the water supply network and thereby corrosion and/or deposits occur which make the occurrence of a damage event more likely, so that the probability values must also be increased.

It has been discovered here that the detection of pressure, flow quantity, temperature, pH level, water hardness, change in pressure over time, change in flow quantity over time, and/or change in temperature over time, make it possible to predict the probability of the occurrence of water damage in an infrastructure object.

It is also advantageous if the at least one structure parameter characterizes properties of inhabitants of an infrastructure object. Properties of inhabitants of an infrastructure object a considered here from the viewpoint of the water supply network and with the aim of monitoring the water supply network as a structure parameter of the infrastructure object. Such parameters characterize effects of the infrastructure object on the water supply network. They can therefore contribute to an improvement of the determination of the probability value.

Properties of the inhabitants of the infrastructure object may, for example, be the number of inhabitants, age of inhabitants, gender of inhabitants, etc. All these parameters may be used, for example, to make statistical statements about the strain on the water supply network.

It is also advantageous if the at least one structure parameter characterizes properties of the water supply network of the infrastructure object and/or the water supply network of connected consumer components. Properties of the water supply network as structure parameters are, for example, parameters which describe the structure or the configuration of the water supply network. This includes pipe lengths, pipe volumes, numbers of branch locations and/or valves, flow paths (in particular, circulation pipes), etc. Structure parameters of connected consumer components may, for example, be indications of the number of connected consumer components, indications of the type of consumer components, etc.

It is also advantageous if the at least one structure parameter characterizes infrastructure properties of the infrastructure object. This group of structure parameters includes parameters which relate to particular, possibly construction-related, aspects of the infrastructure object beyond the water supply network. Such parameters are helpful in particular in order to assess possible consequential damage following an effect that has occurred in the water supply network and to take it into consideration as part of the determination of the probability value. Such a structure parameter may indicate, for example, which structural features the infrastructure object has (for example, wooden construction and or concrete construction), how many floors and/or rooms the infrastructure object has, and so on.

It is also advantageous if the at least one structure parameter is determined with a historical model, wherein in the historical model, events are taken into consideration which affected the infrastructure object and/or the water supply network in the past. In principle, a historical model for considering structure parameters may be structured similar to a historical model for considering water parameters. In particular, long-term effects on the infrastructure object may be considered via a historical model.

It is also advantageous if at least one of the following historical events is taken into consideration in the historical model:

Time of creation of the infrastructure object and/or water supply network;

age of the infrastructure object and/or water supply network; and damage to the water supply network which occurred in the past.

The time of creation of the infrastructure object may, for example, be used to take into consideration fundamental construction-related influences and/or particularities of the infrastructure object or the water supply network in the determination of the probability value.

The age of the infrastructure object and/or water supply network may be used to taken into account, in particular, (usage-related, weather-related, etc.) ageing aspects in the determination of the probability value.

Damage to the water supply network which occurred in the past frequently allows for conclusions about possible further damage occurring in the future. Therefore, the consideration of damage which occurred in the past is helpful for the determination of the probability value.

It is also advantageous if a self-learning algorithm is used in the determination of the at least one probability value in step c), which self-learning algorithm is trained using input data, wherein the input data is obtained from a large number of additional infrastructure objects with water supply networks which are monitored using the described method.

Through the use of the self-learning or machine-learned algorithm, a large amount of content can be taken into consideration in an advantageous manner, which may also take into consideration historical information about previously determined parameters of previously learned patterns of possibly complex groups of parameters. The (temporary) parameters or previously learned patterns may have been learned in particular during an (initial) training phase. The information learned in particular during the (initial) training phase may be represented for example by corresponding configurations (adaptations) and/or links of elements of the algorithm. The elements may be for example model parameters of the algorithm, such as weights, functions, thresholds or the like. The algorithm may be realized by an (artificial intelligence or KI-) model and/or in a (KI-) model. The algorithm may further comprise a plurality of parts or partial algorithms, which may cooperate with one another on one level next to one another and/or on a plurality of levels above one another and/or in a plurality of time steps after one another.

For example, the algorithm may be set up such that it maps a set of input data to at least one output or one set of output data. The at least one piece of information recorded (for example, through sensory means) about the water usually forms an input or input data of the algorithm. The assignment to the at least probability parameter usually forms an output or output data of the algorithm. Sets of data may be provided for example in the form of vectors, such as for example at least one input vector and at least one output vector.

The algorithm may for example be formed in the manner of a so-called machine learning model. For example, the algorithm may be formed by means of at least one artificial neural network. The network usually contains elements or model parameters, by means of which the input data may be mapped to the output data. Corresponding elements or model parameters may comprise for example, nodes, weights, links, thresholds or the like. During a training of the algorithm, at least individual or a plurality of the elements of model parameters may be adapted. In particular, in addition to an (initial) training of the algorithm, it may also be provided that this can be improved during continuous (further) operation. In this context, the algorithm may be executed for example in a self-learning manner. In particular, training phases can be performed during continuous operation (for example at specific times or continuously). For example, during continuous operation, comparative investigations to determine the possibly complex liquid consumption processes may be performed, in order to validate and/or (further) improve the classification performed by the algorithm. Furthermore, the algorithm may (possibly constantly) be improved, in that it (constantly or at least even after an initial training) is trained with new training data. This new training data may for example be generated by new recordings and/or procured in a targeted manner for such water events which (previously) could be classified only with a small amount of precision.

A server on which the method is carried out in whole or in part, is preferably used for carry out the method for monitoring a large number of different water supply networks in infrastructure objects. In this way, a large quantity of data accumulates on the server which may be used in a self-learning system for carrying out the method steps (in particular, step c) and possibly also the steps a) and b)).

Here a control component for a water supply network is also indicated which includes a control device which is configured for carrying out the described method. The control device is preferably part of a control component which may be used in an infrastructure object, in order to perform monitoring, control and regulating functions on the water supply network. The control component may be in particular part of a module, which also comprises a valve with which a flow of water through a pipe of the water supply network may be controlled.

A computer program product for carrying out the described method is also to be disclosed here. Such a computer program product is installed in particular on a server for carrying out the described method, and may be operated there.

The invention and the technical environment are explained in more detail with reference to the illustration. The drawing shows a preferred embodiment, to which, however, the invention is not limited.

FIG. 1 shows an infrastructure object having a described water supply network and means for carrying out the described method.

Shown schematically is an infrastructure object 2 having a water supply network 1 arranged therein which receives water by way of a water source 17 and supplies further to different consumer components 14. The water supply network 1 has water pipes 3 for this purpose, which possibly are also branched at branches 19.

A measuring device 4 with which measurement data may be determined is arranged on the water supply network 1. Such measurement data may be used to determine water parameters 6. The water supply network 1 preferably has at least one controllable valve 10, with which a flow of water through the water supply network 1 or through a pipe of the water supply system 1 may be controlled. A control component 13 of the water supply network 1 particularly preferably exists which is configured to carry out monitoring tasks and control tasks on the water supply system 1 and in particular to control the at least one valve 10 described, and possibly to receive results from the measuring device 4. The control component 13, and measuring device 4, and a valve 10 are particularly preferably arranged in a unit or a module. The control component 13 preferably has a control device 16 in which the described method is saved in whole or in part as a computer program product and with which the described method may be carried out. The control device 16 particularly preferably also has interfaces for establishing data connections 12 to a server 11, which control device is preferably arranged outside the infrastructure object 2. The water parameter 6 is transmitted to the server 11 by way of such a data connection 12.

In addition to the water parameter 6, there also exists at least one structure parameter 5, which is possibly also transmitted to the server 11 by the control component 13 or by the infrastructure object 2 by way of the data connection 12. Embodiments are also possible, however, in which the structure parameter 5 and the water parameter 6 are not transmitted by the control component 13 or the infrastructure object 2 by way of data connections 12, but rather are saved directly on the server 11, for example as part of an initial installation. A probability calculator 20 is used on the server 11 with which a probability value 7 is determined from the available parameters, with which the probability of water damage may be determined. The probability calculator 20 may possibly also comprise an historical model 18, with which temporary parameters may be processed. The probability calculator 20 is preferably a self-learning system, with which input data 15 from a large number of additional infrastructure objects 2 with water supply networks 1 may be taken into account.

The probability value 7 is preferably compared to a threshold value 8. As a function of this comparison, at least one control command 9 is transmitted by the server 11 to the control component 13 or the valve 10 by way of a data connection 12, in order to carry out a measure for reducing the risk of water damage.

LIST OF REFERENCE NUMERALS

1 Water supply network
2 Infrastructure object
3 Water pipe
4 Measuring device
5 Structure parameter
6 Water parameter
7 Probability value
8 Threshold value
9 Control command
10 Valve
11 Server
12 Data connection
13 Control component
14 Consumer component
15 Input data
16 Control device
17 Water source
18 Historical model
19 Branch
20 Probability calculator

The invention claimed is:

1. A method for monitoring a water supply network in an infrastructure object having water pipes and at least one measuring device for monitoring the water supply network, comprising at least the following steps:

a) determining at least one structure parameter that characterizes at least one structure of the infrastructure object or the water supply network;

b) determining at least one water parameter using the at least one measuring device, c) determining at least one probability value for water damage to the infrastructure object, wherein the at least one structure parameter and the at least one water parameter are taken into consideration, and d) comparing the at least one probability value with at least one threshold value and introducing at least one protective measure as a function of a result of the comparison, wherein the protective measure serves at least to reduce or even to avoid the consequence of water damage or the risk of water damage to the infrastructure object.

2. The method according to claim 1, wherein as a function of the probability value, a control command is transmitted to a valve of the water supply network as a protective measure, wherein the valve is actuated by the control command in such a way that water damage, the consequence of water damage, or the risk of water damage is at least reduced or even avoided.

3. The method according to claim 1, wherein at least method step c) is carried out on a server, wherein the server is arranged outside of the infrastructure object and is connected to the control component of the water supply network by way of data connections, wherein the control component is configured to transmit water parameters obtained with the measuring device to the server and to transmit control commands from the server to at least one valve of the water supply network by way of the data connection.

4. The method according to claim 1, wherein the water parameter is at least one selected from the group consisting of pressure, flow rate, temperature, pH level, hardness, change in pressure, change in flow rate, and change in temperature.

5. The method according to claim 1, wherein the determination of the at least one water parameter is performed with a historical model, wherein, in the historical model, temporary water parameters are taken into consideration that were determined in the past in the water supply network.

6. The method according to claim 1, wherein the at least one structure parameter characterizes properties of inhabitants of the infrastructure object.

7. The method according to claim 1, wherein the at least one structure parameter characterizes at least properties of the water supply network of the infrastructure object or consumer components connected to the water supply network.

8. The method according to claim 1, wherein the at least one structure parameter characterizes infrastructure properties of the infrastructure object.

9. The method according to claim 1, wherein the determination of the at least one structure parameter is performed with a historical model, wherein, in the historical model, events are taken into consideration that affected the infrastructure object or the water supply network in the past.

10. The method according to claim 9, wherein at least one historical event is taken into consideration in the historical model that is selected from the group consisting of time of creation of the infrastructure object;
time of creation of the water supply network;
age of the infrastructure object;
age of the water supply network; and
damage to the water supply network that occurred in the past.

11. The method according to claim 1, wherein a self-learning algorithm is used in the determination of the at least one probability value in step c), the self-learning algorithm being trained using input data, wherein the input data is obtained from a large number of additional infrastructure objects with water supply networks that are monitored using the described method.

12. A control component for a water supply network that includes a control device configured to perform the method according to claim 1.

13. A computer program for performing a method according to claim 1.

14. The method according to claim 1, wherein the infrastructure object is a building having the water supply network fixedly installed therein to supply water within the building.

* * * * *